US005773738A

United States Patent [19]

Chou

[11] Patent Number: 5,773,738

[45] Date of Patent: Jun. 30, 1998

[54] PIANO TOY HAVING AUTOMATIC PLAYING KEYS

[76] Inventor: Jin-Long Chou, 10F, No.218, Sec.3, Da-Tung Road, Hsi-Chih Chen, Taipei Hsien, Taiwan

[21] Appl. No.: 881,199

[22] Filed: Jun. 24, 1997

[51] Int. Cl.[6] ..... G10C 3/00; G10C 3/12

[52] U.S. Cl. ..... 84/600; 84/13; 84/18; 84/20; 84/719; 84/720; 446/143; 446/408

[58] Field of Search ..... 84/13, 16–22, 84/94.1, 94.2, 95.1, 95.2, 115, 600, 719–720, 744, 745, DIG. 7; 446/143, 408

[56] References Cited

U.S. PATENT DOCUMENTS 1,667,078 4/1928 Patten .
2,630,040 3/1953 Fraysur ..... 84/102

*Primary Examiner*—William M. Shoop, Jr.
*Assistant Examiner*—Marlon T. Fletcher
*Attorney, Agent, or Firm*—Beveridge, DeGrandi, Weilacher & Young, LLP

[57] ABSTRACT

A piano set having automatic playing keys comprises a bracket having a plurality of fixing columns and mounting sockets. A gear set, linkage set of a gear set driven by a motor and connecting shaft of the keyboard are rotationally mounted thereon. The bracket further includes a controlling circuitry which includes a printed circuit board, a battery set, a microswitch and a speaker and which are electrically connected. The keyboard set includes an upper fixing board and a lower fixing board by which a plurality of keys are movably fixed therebetween. Each of the keys is aligned with a driving gear of the connecting shaft. The upper cover is provided with a front recess in which a fallboard is pivotally disposed thereof by means of a fixing plate. The fallboard is provided with a pair of pressing tabs at both sides. When the fallboard is uncovered, those two pressing tabs will trigger on the microswitch such that the motor is powered to drive the gear set and connecting shaft and the connecting rods. The connecting shaft is provided with a plurality of driving gear which has a recess thereon. Each of the keys is provided with a cam. By the corporation of the recess of the driving gear and the cam of the key, the key will be moved upward and downward while the music is played.

2 Claims, 6 Drawing Sheets

PIANO TOY HAVING AUTOMATIC PLAYING KEYS

FIELD OF THE INVENTION

The present invention relates to a piano toy, more particularly, to a piano toy wherein when the fallboard is uncovered, a music will be automatically played and the keys are also depressed to stimulate the substantial playing of the piano. This piano top features an aesthetic appearance as well as a special effect.

DESCRIPTION OF PRIOR ART

In the existing piano toy for young children, the sound or music is generated by depressing the keys of the keyboard. As a matter of fact, this piano toy is stimulated to a real piano. Even there are a plurality of piano toys have been introduced to the market, it inherits the same style as the conventional one. Those fixed style and playing mode can not satisfy the requirements from the young children since curiosity and the funning shall be placed in the first priority. In light of this, there is still a room for improving the existing piano toy.

SUMMARY OF THE INVENTION

It is the objective of this invention to provide a novel piano toy in which when the power is triggered on, not only will the music be suitably broadcasted from the speaker built-in, but also will automatically move the keys to accompany the music such that it seems the music is played by the depressed keys.

According to one aspect of the present invention, the connecting shaft is composed by a plurality of sectors and each of the sectors is rotationally supported on a mounting socket and each of the sectors is interconnected to the adjacent sector. By this arrangement, the connecting shaft can be smoothly rotated while the overall manufacturing cost is considerably reduced. The reason for configuring a connecting shaft with a plurality of sectors instead of a single connecting shaft is that a longer shaft tends to deform after a period of usage. Once the shaft is deformed, a plurality of keys connected will be rendered motionless. In order to avoid the deformation of a longer shaft, the connecting shaft shall be made from high class material and this will inevitably increase the manufacturing cost.

In order to achieve the objective set forth, the piano toy having automatic playing keys is provided with a keyboard set which is configured by a plurality of keys which can be triggered to move upward and downward. When the fallboard is uncovered, those two pressing tabs will trigger on the microswitch such that the motor is powered to drive the gear set and connecting shaft and the connecting rods. The connecting shaft is provided with a plurality of driving gear which has a recess thereon and each of the keys is provided with a cam. By the corporation of the recess of the driving gear and the cam of the key, the key will be moved upward and downward during the music is played from the IC of the printed circuit board. As a result, while the music is played, a plurality of keys are automatically moved upward and downward such that it seems that the music is played by the depressed keys.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
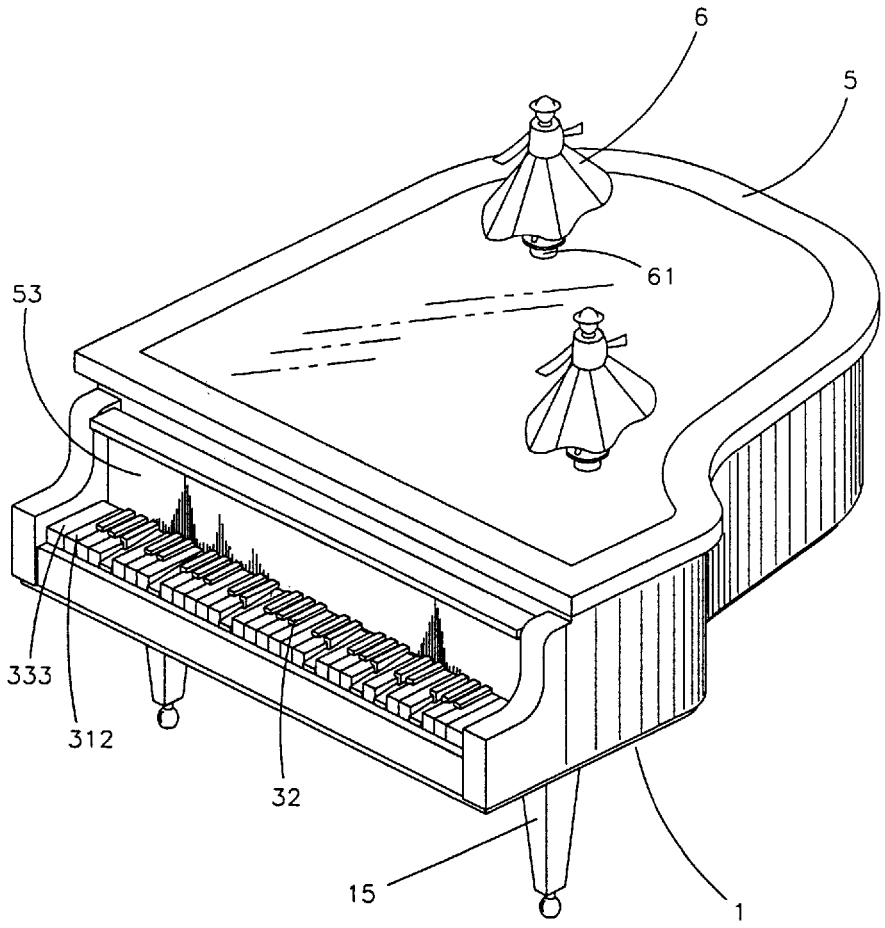
FIG. 1 is a perspective view of the piano toy made according to the present invention.

Referring to FIG. 1, the piano toy generally has a conventional shape of a real piano. Please also referring to FIG. 2, the piano toy made according to the present invention generally comprises a bracket 1, a gearbox 2, a keyboard assembly 3, a controlling circuitry 4, an upper cover, and a magnetic doll 6. The detailed description of each of these components will be detailedly described as follow.

The bracket 1 has an identical shape of a real piano and the peripheral of the bracket 1 is provided with a fixing flange 11. The bracket 1 is provided with a plurality of positioning posts 12 which has a recess atop for receiving the shaft of the gear set 23. The bracket 1 is further provided with a plurality of mounting sockets 13 for rotationally mounting a linkage 24 and connecting shaft 34 thereon. The bracket 1 further provides with a plurality of fixing columns 14 in which a connecting post 522 of the upper cover 5 can be releasably engaged therein. The bracket 1 further includes a plurality of supporting legs 15 to support the bracket 1.

The gearbox 2 is configured by a mounting plate 21, a motor 22, a gear set 23, and a linkage set 24. Those components are fixed by an anchoring post 211. The second terminal gear 232 of the gear set 23 is a driving eccentric gear 233 which is meshed with a magnetic gear 234. The magnetic gear 234 is provided with a pair of magnets 2341. The first terminal gear 231 is meshed with a second linking rod 241 of the linkage set 24. The other end of the first terminal gear 231 is meshed with the second connecting rod 242 which in turn is connected with a third connecting rod 243. The overall design is to give the gear set 23 with low speed while with high torque. By this arrangement, an effective power transmission can be attained to drive other components. The second connecting rod 242 is provided with a fixing end 2421 at one end and which is provided with a movable gear 2422. The other end is mounted with an end gear 2424 and a spring 2423 is enveloped onto the connecting rod 242.

Figure 5:
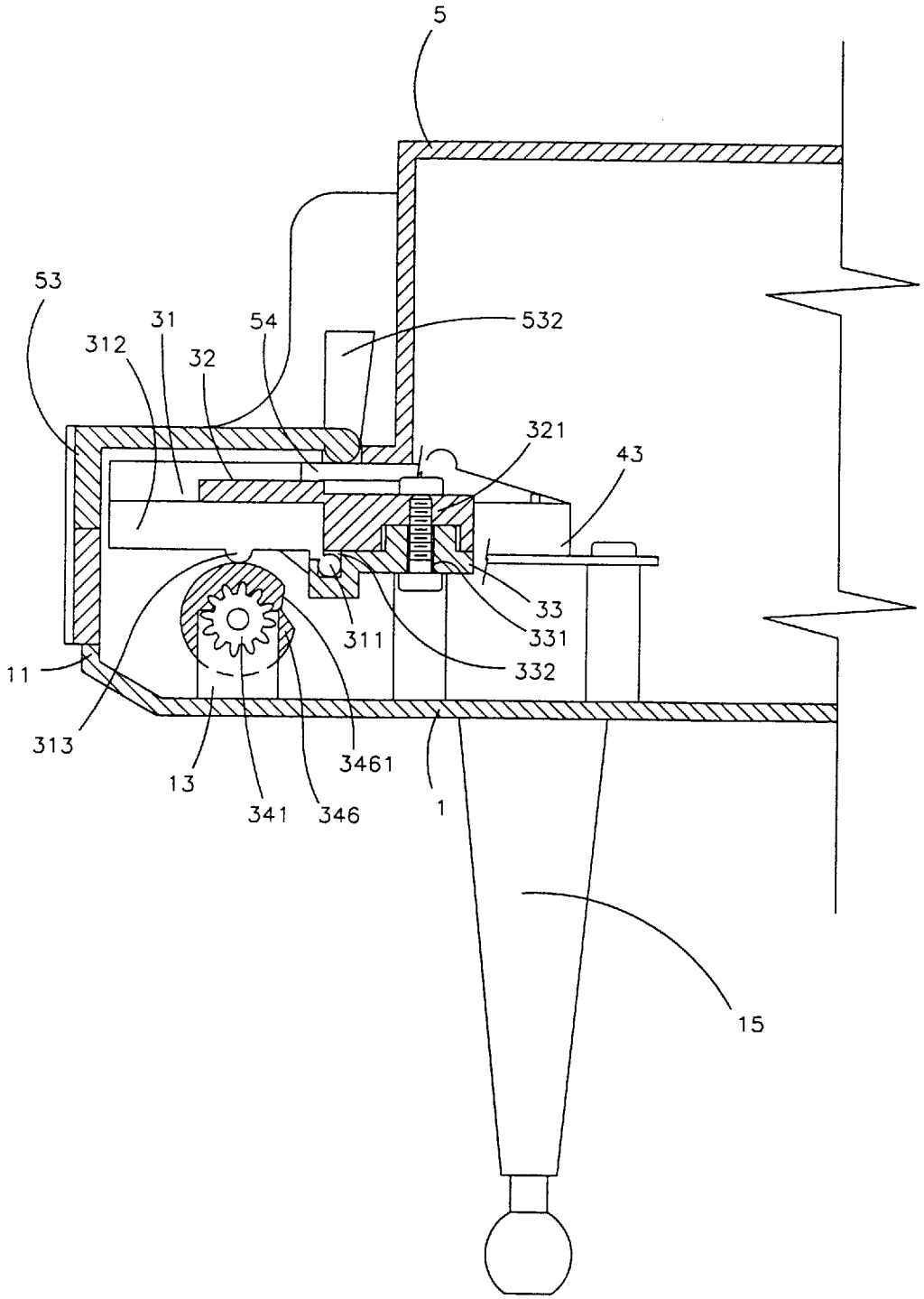
FIG. 5 is a side cross sectional view of the keyboard assembly.
Figure 6:
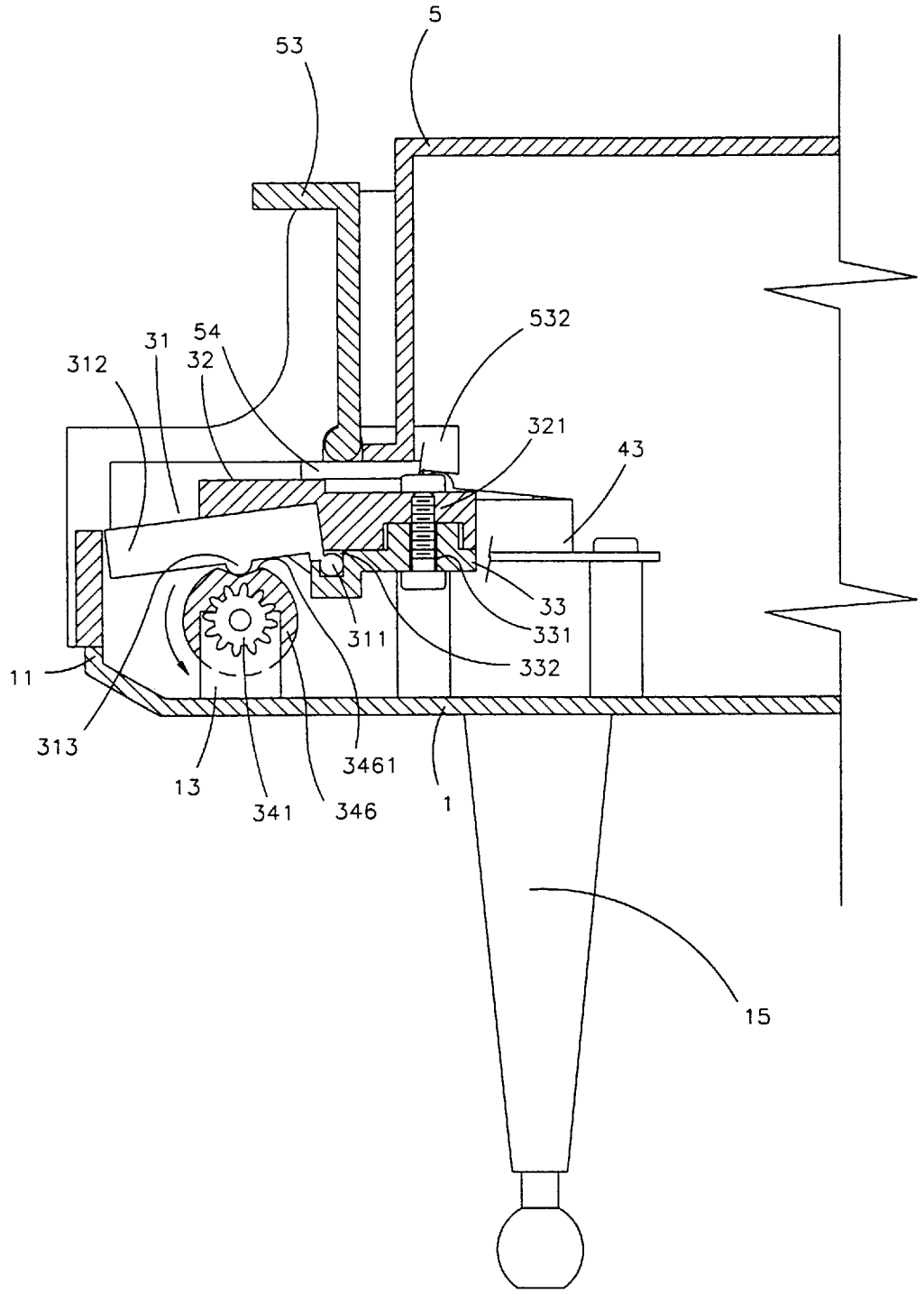
FIG. 6 is a schematic illustration showing the operation after the fallboard is uncovered.

Referring to FIGS. 5 and 6, the keyboard assembly 3 is configured by a keyboard 31, a upper fixing board 32, a lower fixing board 33 and a connecting shaft 34. The keyboard 31 is configured by a plurality of keys 312 and each of the keys 312 is extended with a shaft 311. Each of the shafts 311 are received respectively within the receiving grooves 322 of the lower fixing board 33. The overall length of the keys 312 are equaled to the span between the end tabs 333 disposed at both ends of the lower fixing board 33, as a result, those keys 312 can be moveably disposed within the span between the end tabs 333. Each of the keys 312 is provided with a cam 313 which has semi-circular shape. The upper fixing board 32 and the lower fixing board 33 can be fixedly connected by means of screws which are locked into the fixing portions 321 and 331. As a result, the keyboard 31 is completed. Meanwhile, the elongate extensions of those shafts 311 which are received within the receiving grooves 332 of the lower fixing board 32 are served as a supporting point. The connecting shaft 34 includes a plurality of sectors. The left and right sectors are a shaft and a driving gear 341. Each of the sectors is provided with a positioning post 342 and a square positioning post 343 which can be received into a corresponding positioning hole 344 and square recess 343. The number of the driving gear 346 is corresponding to the number of the keys 312 of the keyboard 31 and each of the driving gears 346 is aligned with a corresponding key 312 of the keyboard 31. Each of the driving gear 346 is provided with a V-shape recess 3461. The location of the V-shape recess 3461 in each driving gear 346 is different from the other one, i.e. those V-shape recesses 3461 are arranged in randomly.

The controlling circuitry 4 is configured by a printed circuit board 41, a battery set 42, a microswitch 43 and a speaker 44. The printed circuit board 41 includes a plurality of electronics and is fixedly attached at a suitable position on the bracket 1. The printed circuit board 41 is electrically connected to the battery set 42, the microswitch 43, the speaker 44 and a motor 22. This is known to the skilled in the art, not detailedly description is given.

The upper cover 5 can be tightly enclosed onto inner portion of the peripheral flange 11 of the bracket 1. The upper cover 5 includes a front recess 51 having a pair of shaft holes 511 thereof. The pivoting shaft 531 of the fallboard 43 can be pivotally received within the shaft holes 511 of the front recess 51. The fixing plate 54 is provided with a pair of fixing portions 541 at both sides. By means of a pair of screws, the fixing portions 541 can be locked to the threaded holes 512. The pivotal shaft 531 of the fallboard 53 is extended with a pressing tab 532 which is projected over the external portion of the front recess 51. The middle portion of the rear recess 52 is provided with a round rail 521 which is merely for explanation and has nothing to do with the present invention. The round rail 521 is corresponding to the magnetic gear 234 and the later may free rotate within the round rail 521. The rear recess 52 is provided with a plurality of positioning posts 522 which can be releasably engaged with the fixing columns 14 of the bracket 1.

The magnetic doll 6 is merely disclosed for illustration and has nothing to do with the present invention. The magnetic doll 6 has a doll figure at the upper portion and a magnet 61 in the lower portion. The lower magnet 61 can be attracted by the magnets 2341 of the magnetic gear 234. The magnetic doll 6 can be disposed at the top surface of the upper cover 5.

Referring to FIGS. 5 and 6, when the fallboard 53 is uncovered, the pressing tab 532 is pivoted downward and one side of the pressing tab 532 will trigger on the microswitch 43 of the bracket 1 such that the power from the battery set 42 is supplied to the printed circuit board 41. As a result, the music stored within the IC will be broadcasted from the speaker 44. On the other hand, during the music is broadcasted from the speaker 44, the following movement is also performed.

Figure 2:
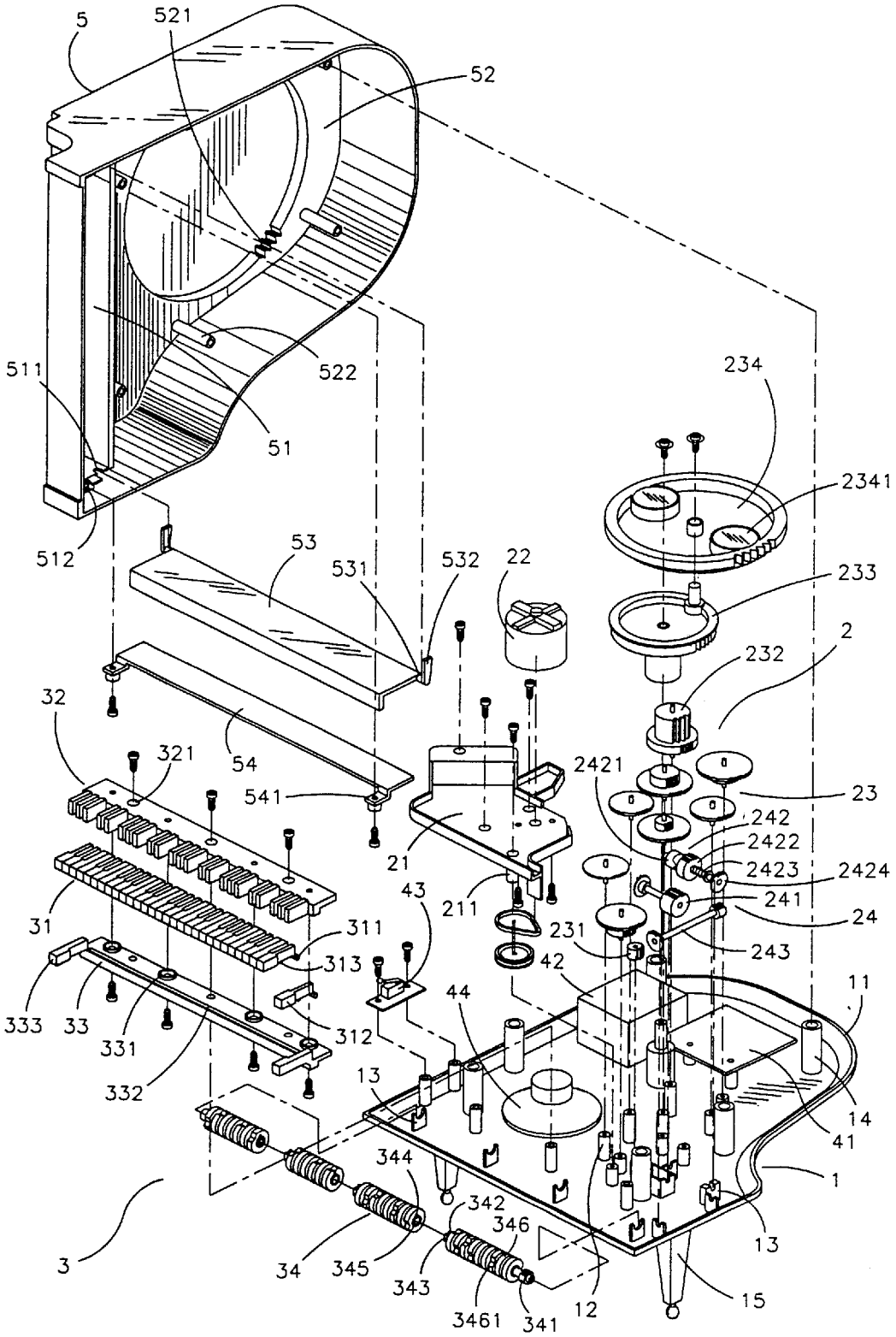
FIG. 2 is an exploded perspective view of the piano toy shown in FIG. 1.
Figure 3:
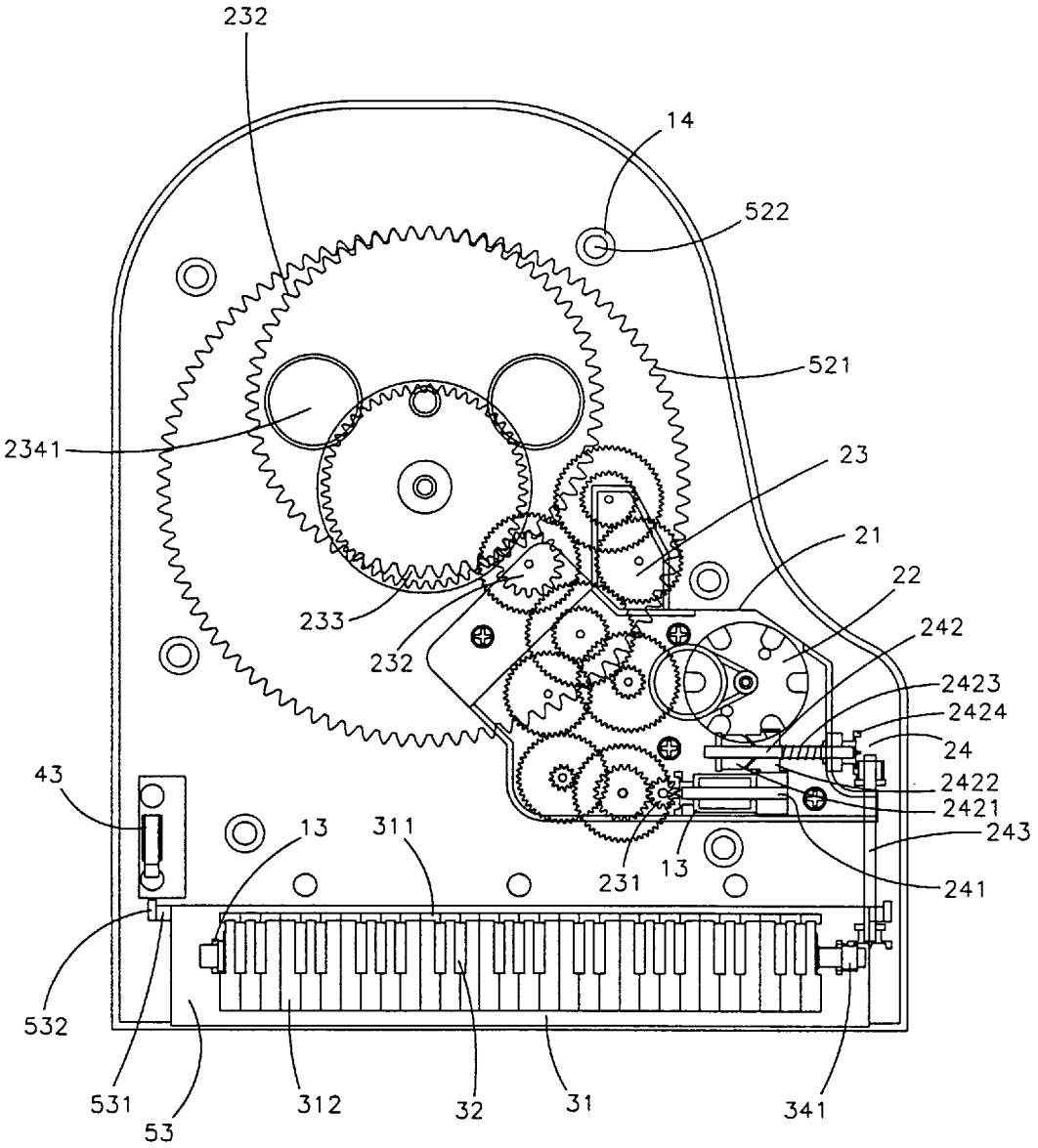
FIG. 3 is a top plan view showing the inner configuration of the piano toy shown in FIG. 1.
Figure 4:
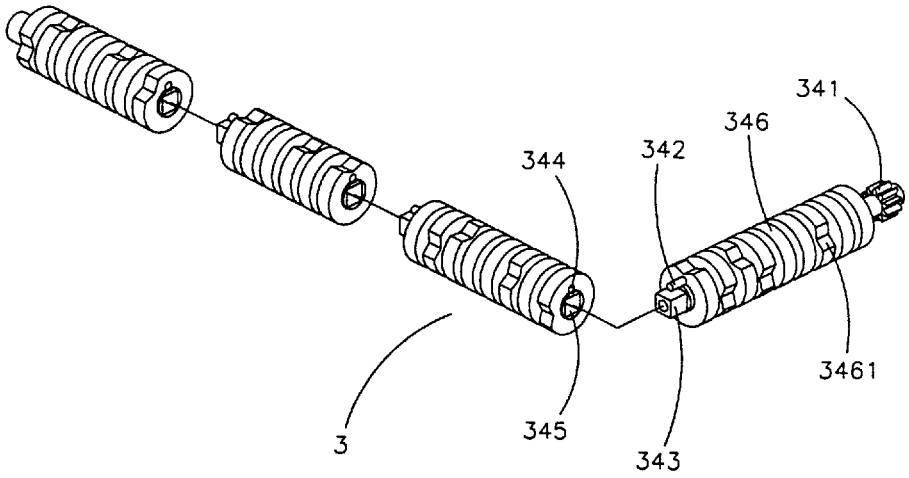
FIG. 4 is an exploded perspective view of the rotating shaft.

In the first mode, as clearly shown in FIGS. 1, 2 and 3, this is merely for illustration and has nothing to do with the present invention. When the gear set 23 is driven by the motor 22, the eccentric gear 233 is meshed by the second terminal gear 232 located at the other end. The shaft pin located on the peripheral off the eccentric gear 233 will insert into the central shaft hole of the magnetic gear 234 disposed above. The magnetic gear 234 is freely rotated within the round rail 521 of the upper cover 5. As a result, the magnet 2341 disposed thereof will conduct an eccentric movement. Meanwhile, the polarities of the magnet 2341 and the magnet 61 disposed under the magnetic doll 6 are different from each other. In light of this, the magnetic doll 6 will be rotated by the driving force from the magnet 2341 of the magnetic gear 234. Consequently, the magnetic doll 6 is skiing on the upper cover 5.

Referring to FIGS. 3, 5 and 6, the second operating mode are disclosed and which is also the main features of the present invention. When the gear set 23 is driven by the motor 22, the first terminal gear 231 will drive the first connecting rod 241 of the linkage 24. The other end of the first connecting rod 241 is meshed with the other end of the second connecting rod 242 and the other end of the second connecting rod 242 is meshed with the third connecting rod 243 and the other end of the third connecting rod 243 may drive the driving gear 341 of the connecting shaft 34. Consequently, the connecting shaft 34 begins to rotate. As a result, the driving gear 346 is also rotated such that the cam 313 disposed under the key 312 will press against to the outer peripheral of the driving gear 346. When the V-shape recess 3461 is aligned with the cam 313, the cam 313 will move downward firstly and then rotate together with the driving gear 346. As a result, the cam 313 is lifted upward again. Meanwhile, as the keyboard 31 is configured by a plurality of keys 312 and the shaft 311 of the key 312 is individually received within the receiving groove 332 in order. Because the number of the driving gear 346 equals to the number of the keys 312 and are aligned with respect to each other. By this arrangement, the key 312 can be moved upward and downward as the cam 313 is controlled by the V-shape recess 3461 of the driving gear 346. Besides, since each of the V-shape recesses 3461 is disposed in different position, consequently, some keys 312 are moved upward while some keys 312 are moved downward, please referred to FIG. 1. The jumping of the keys 312 of the keyboard 31 will be started right after the fallboard 53 is uncovered and once the fallboard 53 is uncovered, the IC will broadcast a stored music through the speaker 44. By this arrangement, the user may not only enjoy the music broadcasted by the IC, but also may enjoy the dance of the keys 312. A special entertainment is therefore provided.

Referring to FIGS. 2 and 3, the second connecting rod 242 is provided with a fixing portion 2421 in the front portion and a movable gear 2422 in the rear portion. Furthermore, a spring 2433 is disposed between the movable gear 2422 and the end gear 2424. When the movable gear 2422 of the keys 312 are inadequately pressed by external force, the movable gear 2422 will be released from the fixing portion 2421 and pressed against onto the spring 2423. As a result, the accident damage to the keys 312 can be avoided.

From the forgoing description, the present invention can be concluded with the following advantages.

1. Once the fallboard is uncovered, the power is switched on, a plurality of keys will start jumping to accompany the music from the IC. This is really a genuine device which inherits both an aesthetic appearance as well as decorating effect. This is completely different to the existing piano toy.

2. Since the second connecting rod is provided with a safety means, the connecting shaft will not be readily damaged, especially when excess load is exerted onto the keys. On the other hand, the connecting shaft is configured by a plurality of sectors and each of the sectors is supported on different mounting sockets. By this arrangement, the overall configuration is durable without deformation. Furthermore, the manufacturing cost can be therefore reduced.

The main features of the present invention is the keys can be readily jumped while the music is played. However, the magnetic doll is a conventional art and which has nothing to do with the present invention.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A piano toy having automatic playing keys, comprising a bracket having an identical shape of a real piano and the peripheral of said bracket being provided with a fixing flange, said bracket being provided with a plurality of positioning posts which are equal to the gears of a gear set, said bracket being provided with a plurality of U-shape mounting sockets for rotationally mounting a linkage and connecting shaft thereon, said bracket being provided with a plurality of fixing columns, a plurality of supporting legs being provided thereunder for supporting said bracket;

a gearbox being configured by a mounting plate, a motor, a gear set, and a linkage set, said gear set and said linkage set being disposed between said mounting plate and said bracket and which are releasably connected by fixing posts, said gear set being configured by a plurality of gears to configure a reduced transmission ratio, the first terminal gear being connected with said linkage set and which in turn drives a connecting shaft of said keyboard;

a keyboard assembly being configured by a keyboard having a plurality of keys and each of said keys being extended with a shaft which is in turn received respectively within a receiving groove of a lower fixing board, the overall length of said keys being equaled to the span between the end tabs disposed at both ends of said lower fixing board, each of said keys being provided with a cam which has semi-circular shape, an upper fixing board and said lower fixing board being fixedly connected by means of screws which are locked together and are jointly fixed to said bracket, a connecting shaft including a plurality of sectors, the left and right sides being a shaft and a driving gear, each of said driving gear being aligned with a corresponding key and which is provided with a recess, each of said recess being disposed in different position;

a controlling circuitry being configured by a printed circuit board, a battery set, a microswitch and a speaker, said printed circuit board being fixedly disposed onto said bracket and being electrically connected with said battery set, said microswitch, the speaker and a motor; and an upper cover being tightly enclosed onto inner portion of said peripheral flange of said bracket, said upper cover including a front recess having a pair of shaft holes thereof, a pivoting shaft of a fallboard being pivotally received within said shaft holes of said front recess, said pivotal shaft of said fallboard being extended with a pressing tab which is projected over the external portion of said front recess, said upper cover further including a rear recess having a plurality of positioning posts thereof and which can be releasably engaged with said fixing columns of said bracket;

wherein by the combination of those described components, when said microswitch is triggered and a power is supplied to said controlling circuitry, wherein said motor is rotated and which in turn will drive said gear set and said connecting rod such that said connecting shaft is rotated, by the corporation of said recess of said driving gear and said cam disposed under said key, said key can be moved upward during the rotation of said driving gear, meanwhile, said speaker is also broadcasting music.

2. A piano toy having automatic playing keys as recited in claim 1, wherein said connecting shaft includes a plurality of sectors, each of said sectors is provided with a positioning post and a square positioning post which can be received into a corresponding positioning hole and square recess of an adjacent sector.

* * * * *